US012507801B1

(12) United States Patent
Pattie

(10) Patent No.: US 12,507,801 B1
(45) Date of Patent: Dec. 30, 2025

(54) SHELF APPARATUS

(71) Applicant: Richard Pattie, Vaughan (CA)

(72) Inventor: Richard Pattie, Vaughan (CA)

( * ) Notice: Subject to any disclaimer, the term of this patent is extended or adjusted under 35 U.S.C. 154(b) by 0 days.

(21) Appl. No.: 18/464,468

(22) Filed: Sep. 11, 2023

(51) Int. Cl.
*A47B 96/02* (2006.01)
*A47B 55/00* (2006.01)

(52) U.S. Cl.
CPC ..... *A47B 96/028* (2013.01); *A47B 55/00* (2013.01)

(58) Field of Classification Search
CPC ..... A47B 57/045; A47B 55/00; A47B 21/06; A47B 63/00; A47B 96/028; A47F 5/04; A47F 5/16
USPC ..... 211/196, 153; 248/116, 127, 148, 150
See application file for complete search history.

(56) References Cited

U.S. PATENT DOCUMENTS 3,162,148 A * 12/1964 Ganz ..... A47B 57/045 248/220.43
4,026,220 A * 5/1977 Schuring, Jr. ..... A47G 7/041 211/186
4,429,889 A * 2/1984 Westra ..... B65H 31/00 280/47.35
4,703,910 A * 11/1987 Ross ..... B44D 3/02 248/463
5,195,714 A * 3/1993 Stewart ..... F21V 1/06 248/448
5,394,997 A * 3/1995 Gollob ..... A47F 7/141 211/187
5,575,444 A * 11/1996 Otema ..... A47B 57/045 248/242
D401,084 S * 11/1998 Martin ..... D6/675.3
6,086,028 A * 7/2000 Pfister ..... A47B 21/06 108/50.01
6,422,404 B2 * 7/2002 Schmidt ..... A47F 5/0018 211/90.04
6,591,996 B1 * 7/2003 Wu ..... A47B 96/067 211/187
D478,227 S * 8/2003 Peyker ..... D6/678.3
6,808,152 B2 * 10/2004 Fell ..... A47F 5/10 248/441.1
7,665,860 B2 * 2/2010 Demarest ..... A47F 3/001 362/85
D689,715 S * 9/2013 Wong ..... D6/675.1
(Continued)

FOREIGN PATENT DOCUMENTS

EP 2556773 B1 * 10/2014 ..... A47F 10/02

*Primary Examiner* — Patrick D Hawn
(74) *Attorney, Agent, or Firm* — Orin Del Vecchio

(57) ABSTRACT

A shelf apparatus that is configured to be either placed on a horizontal support surface or mounted to a vertical support surface. The present invention includes a central support member wherein the central support member includes a contiguously formed first portion, second portion and third portion. The front of the central support member is manufactured from a translucent material and is illuminated by a light member disposed in the interior volume of the central support member. The shelf apparatus includes a plurality of shelf members releasably secured to opposing sidewalls of the central support member. The shelf members are operably coupled to the central support member in a plurality of different angles that include a right angle, an acute angle and an obtuse angle. The central support member further includes a charging module and a graphical display module configured to display parameters such as time and temperature.

10 Claims, 4 Drawing Sheets

(56) References Cited

U.S. PATENT DOCUMENTS

| | | | | |
|---|---|---|---|---|
| D722,243 | S * | 2/2015 | Kehoe | D6/675.3 |
| 10,405,651 | B1 * | 9/2019 | Kramer | A47F 7/16 |
| 10,426,264 | B2 * | 10/2019 | Kramer | A47F 5/0025 |
| 10,463,151 | B2 * | 11/2019 | Murphy | A47B 57/34 |
| 11,684,182 | B2 * | 6/2023 | Nelson | A47F 5/16 211/135 |
| 2005/0285010 | A1 * | 12/2005 | Ito | G11B 33/0461 248/131 |
| 2009/0188880 | A1 * | 7/2009 | Yang | A47K 5/02 211/113 |
| 2013/0032554 | A1 * | 2/2013 | Namngani | A47B 17/033 211/69.5 |
| 2018/0235361 | A1 * | 8/2018 | Ching | A47B 21/06 |
| 2024/0000225 | A1 * | 1/2024 | Rogers | A47B 21/06 |

* cited by examiner

SHELF APPARATUS

FIELD OF THE INVENTION

The present invention relates generally to storage shelves and the like, more specifically but not by way of limitation, a shelf apparatus that is configured to be either mounted to a vertical support surface or placed on a horizontal support surface wherein the present invention includes elements such as but not limited to support shelf members, light, temperature and time outputs.

BACKGROUND

Shelves and shelving systems are well known in the art. Shelving systems include but are not limited to industrial shelves that are employed for storage of items in areas such as but not limited to a warehouse as well as the various types of shelves that are often found in residential application. There are a multitude of different styles of shelves with most being either mounted to a wall or self-standing. Commercially available shelving systems are manufactured from various different types of materials such as but not limited to wood, metal or plastic.

While a multitude of shelving systems exist, all provide only a singular function which is the receipt and storage of an item. Functions such as but not limited to the providing of light and time are not integrated into conventional shelving systems. Additionally, conventional shelving systems are configured to be either self-standing or mounted to a wall. Commercially available shelving systems are not configured to be either placed on a horizontal support surface and further be configured to be vertically mounted to a wall. Moreover, most commercially available shelving systems are typically constructed for a singular purpose and/or space and are most often not adaptable to be deployed for alternate locations and/or uses.

Accordingly, there is a need for a shelf apparatus that is configured to be either mounted to a wall or placed on a support surface wherein the present invention is sized to be adaptable for various locations and applications and wherein the present invention integrates other features such as but not limited to lighting elements and time display.

SUMMARY OF THE INVENTION

It is the object of the present invention to provide a shelf apparatus that is configured to be mounted to a vertical support surface or placed on a horizontal support surface wherein the present invention includes a central support member.

Another object of the present invention is to provide a shelving system that includes a plurality of shelf members oriented at alternate angles wherein the central support member is further configured to emit light from one side thereof.

A further object of the present invention is to provide a shelf apparatus that is configured to be mounted to a vertical support surface or placed on a horizontal support surface wherein the shelf members are operably coupled to opposing sides of the central support member.

Yet a further object of the present invention is to provide a shelving system that includes a plurality of shelf members oriented at alternate angles wherein the central support member includes proximate the bottom end thereof a time and temperature display.

Still another object of the present invention is to provide a shelf apparatus that is configured to be mounted to a vertical support surface or placed on a horizontal support surface wherein the present invention further includes a mounting template for vertical mounting on a wall.

An additional object of the present invention is to provide a shelving system that includes a plurality of shelf members oriented at alternate angles wherein the present invention further includes a charging module operable to provide charging of personal electronic devices.

Yet a further object of the present invention is to provide a shelf apparatus that is configured to be mounted to a vertical support surface or placed on a horizontal support surface wherein the light member on the central support member is configured to be activated through motion detection.

Still another object of the present invention is to provide a shelving system that includes a plurality of shelf members oriented at alternate angles is to provide a power supply that is operable to be either battery operated or operated via a traditional power source.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
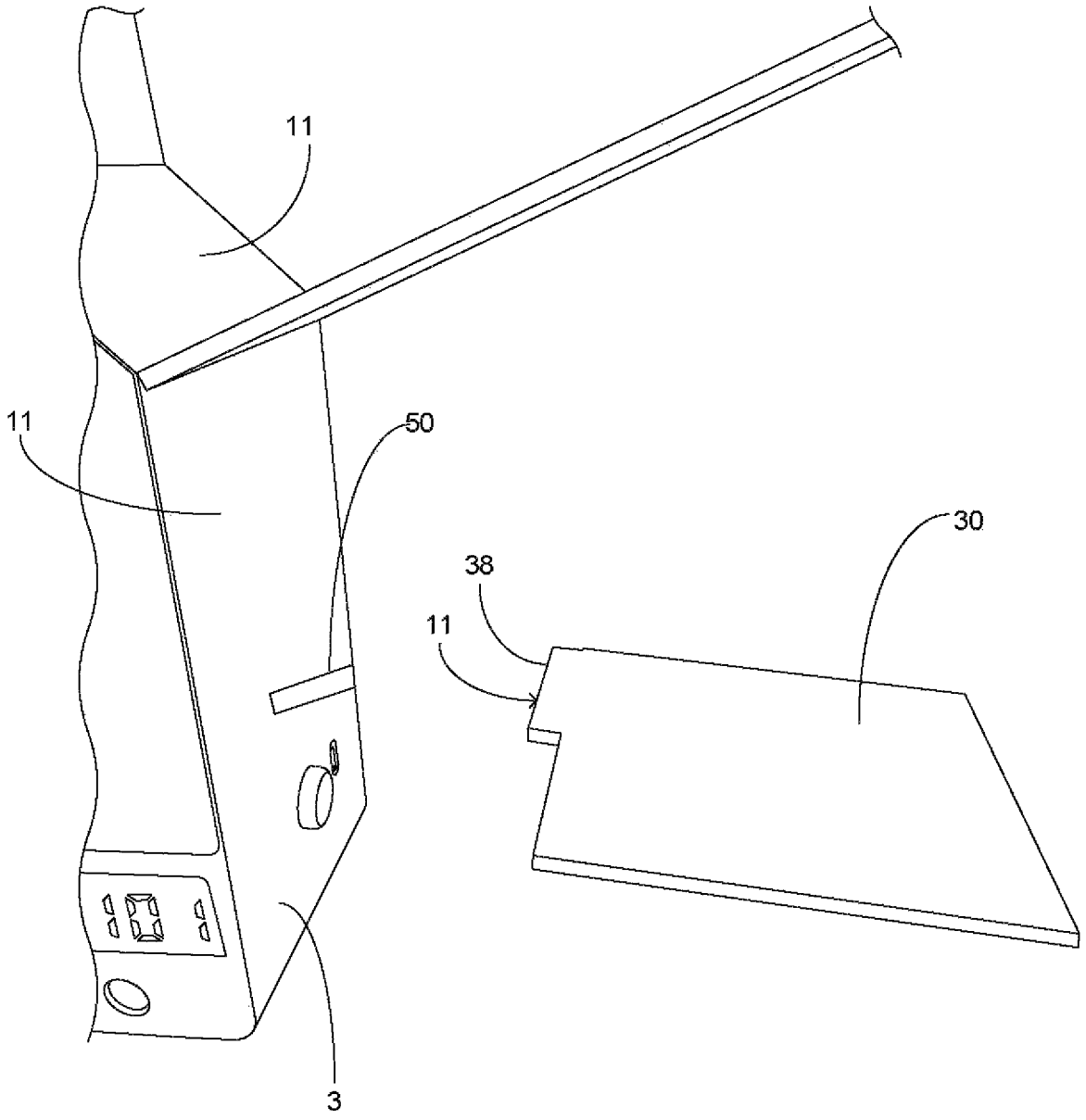
FIG. 1 is a detailed view of a shelf member of the present invention.
Figure 2:
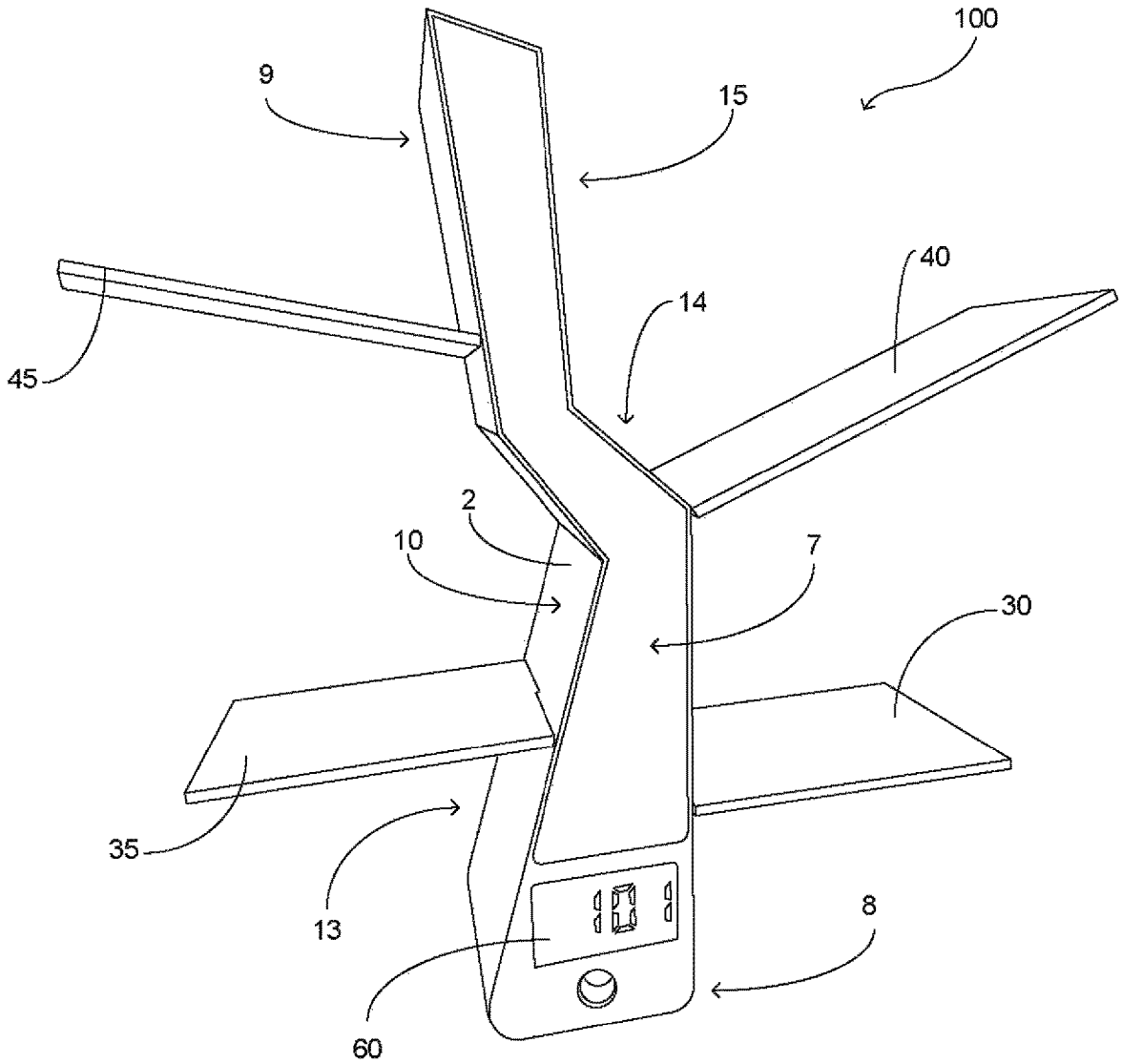
FIG. 2 is a front view of the present invention.
Figure 3:
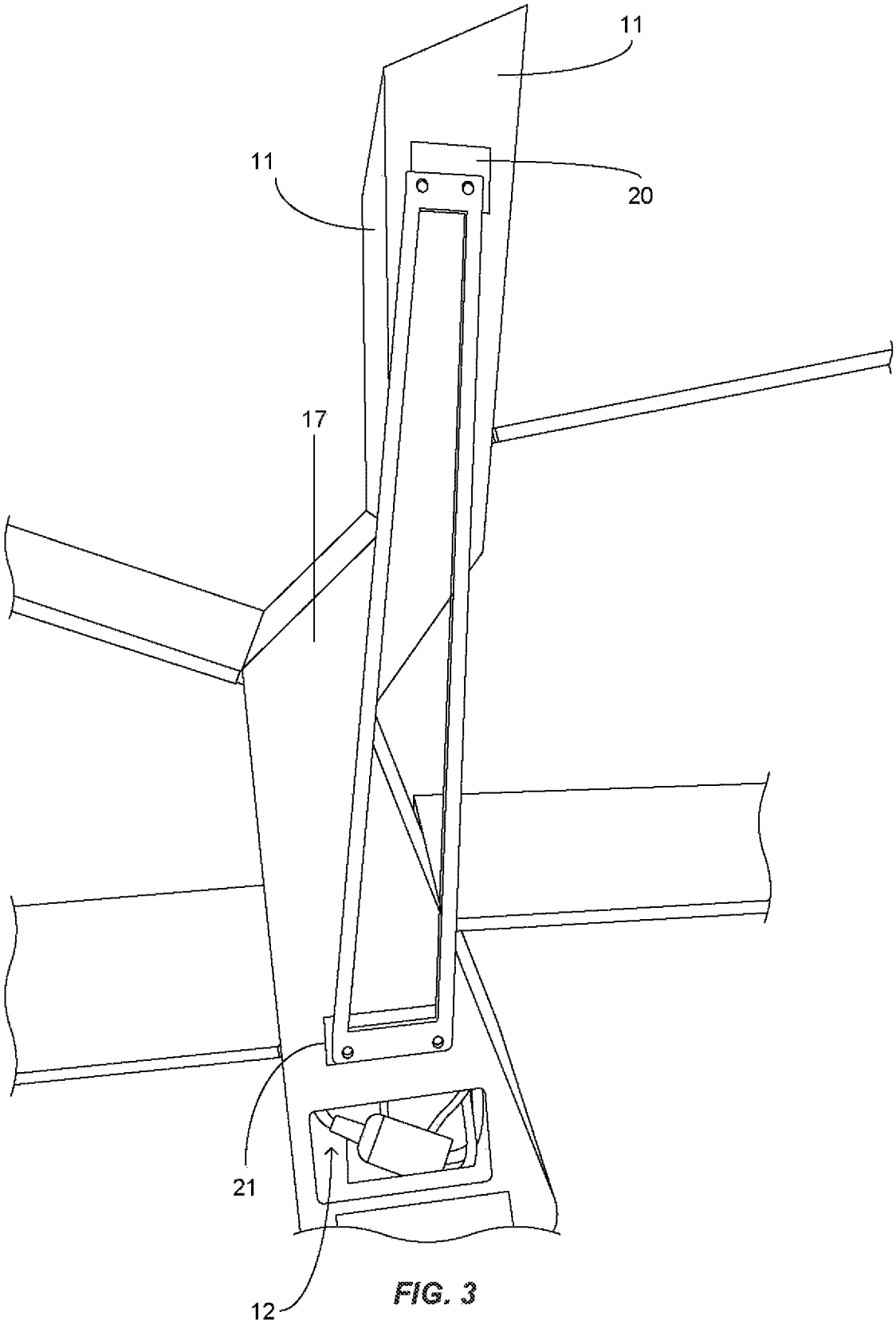
FIG. 3 is a rear view of the present invention with the mounting templated positioned thereon.
Figure 4:
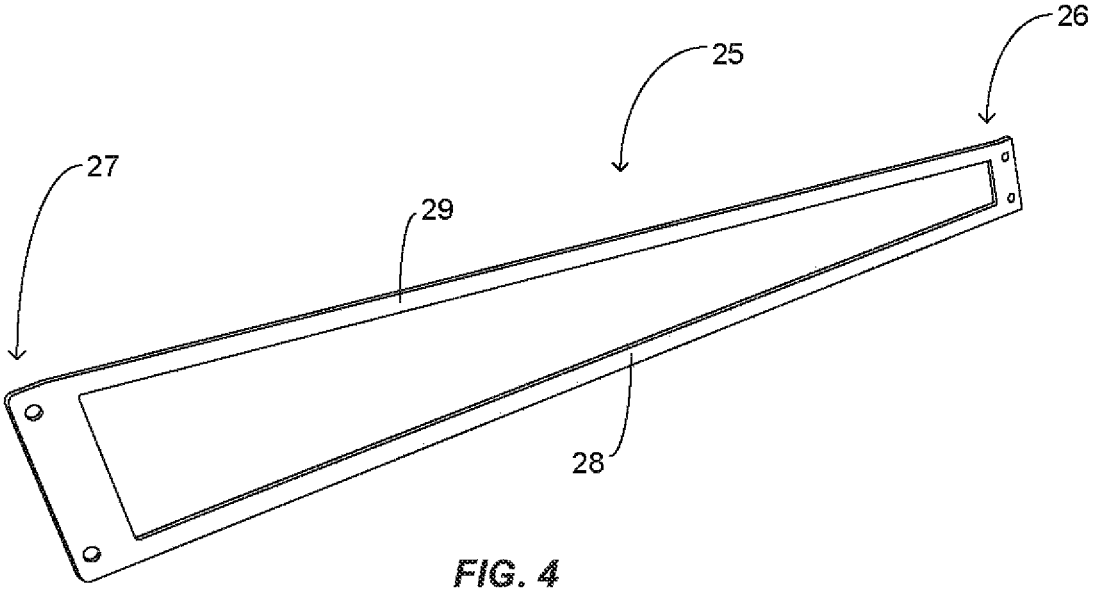
FIG. 4 is a perspective view of the mounting template.
Figure 5:
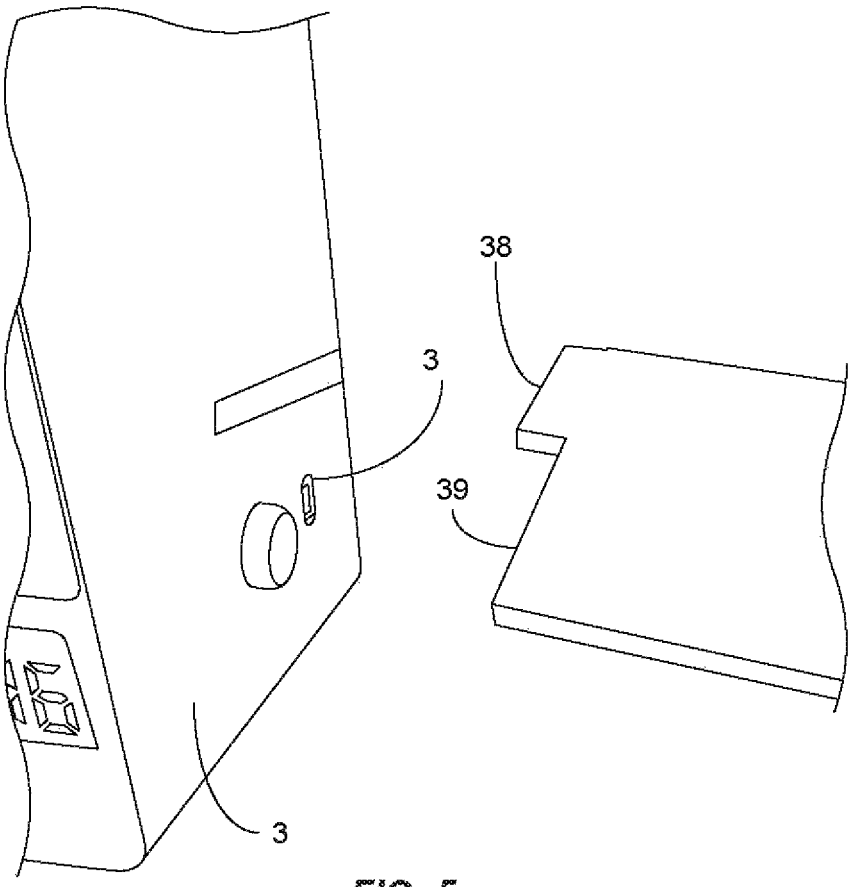
FIG. 5 is a detailed view of the bottom end of the central support member and second end of a shelf member.

Referring now to the drawings submitted herewith, wherein various elements depicted therein are not necessarily drawn to scale and wherein through the views and figures like elements are referenced with identical reference numerals, there is illustrated a shelf apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the shelf apparatus 100 includes a central support member 10. The central support member 10 includes a plurality of walls 11 forming an interior volume 12. The walls 11 are contiguously formed utilizing suitable techniques. It is contemplated within the scope of the present invention that the central support member 10 could be formed utilizing an alternate quantity of walls 11 than illustrated herein so as to provide a central support member 10 that has a different shape. The central support member 10 includes a first portion 13, second portion 14 and third portion 15 that are contiguously formed. The first portion 13 is proximate the first end 8 of the central support member 10 and the third portion 15 is proximate the second end 9 of the central support member 10. The first portion 13 is angular in orientation with a support surface on which the a shelf apparatus 100 has been superposed. The second portion 14 of the central support member 10 is oriented at an angle that is opposing to the angle of the first portion 13. The third portion 15 extends upward from the second portion 14 and is angular with respect thereto.

The front member 7 of the central support member 10 is manufactured from a translucent material such as but not limited to plexiglass. The shelf apparatus 100 includes a light member (not particularly illustrated herein) wherein the light member provides illumination of the front member 7. It is contemplated within the scope of the present invention that the front member 7 could be formed so as to partially extend around the sidewalls 2,3 of the central support member 10. It should be further understood within the scope of the present invention that the central support member 10 could be provided in alternate sizes. The rear wall 17 has formed therein a first aperture 20 and a second aperture 21. The first aperture 20 and second aperture 21 are provided so as to facilitate mounting of the shelf apparatus 100 onto a vertical wall. First aperture 20 and second aperture 21 are operable to have a fastener inserted thereinto wherein the fastener is extruding from a wall. The mounting template 25 is employed to provide a technique to ensure a vertically level mounting of the shelf apparatus 100 to a wall. The mounting template includes a first end 26 and a second end 27 wherein the second end 27 has a width greater than that of the first end 26. The mounting template 25 includes a first longitudinal member 28 and a second longitudinal member 29 wherein the second longitudinal member 29 is oriented at an acute angle with the first longitudinal member 28. This is to ensure proper positioning of the central support member 10 due to the shape thereof.

The shelf apparatus 100 includes a first shelf member 30 and a second shelf member 35 that are operably coupled to the first portion 13 of the central support member 10. The first shelf member 30 is manufactured from a suitable rigid material and is planar in manner. The first shelf member 30 is secured to the first portion 13 being perpendicular thereto. The second shelf member 35 is manufactured from the same material as the first shelf member 30. The second shelf member 35 is operably coupled to first portion 13 of the central support member 10 wherein the angular orientation therebetween is obtuse, specifically with the sidewall 2.

A third shelf member 40 is operably coupled to the second portion 14 of the central support member 10 and extends outward therefrom. The third shelf member 40 is oriented with respect to the second portion 14 such that an obtuse angle exists therebetween. A fourth shelf member 45 is operably coupled to the third portion 15 of the central support member 10. The fourth shelf member 45 is coupled to the third portion 15 wherein an acute angle exists therebetween.

All of the aforementioned shelf members are operably coupled to the central support member 10 utilizing the same technique. Illustrated herein in FIG. 1 is shelf member 30 illustrating the bottom edge 37 configuration thereof. It should be understood within the scope of the present invention that all of the shelf members are similarly configured and operably couple with the central support member 10 employing the same technique. The bottom edge 37 includes a first section 38 and a second section 39 wherein the second section 39 is inset with respect to the first section 38. The first section 38 is configured to be journaled into slot 50 with the second section 39 ending adjacent to and in contact with the sidewall 3. The aforementioned provides a technique to releasably secure the shelf member 30 to the central support member 10.

The shelf apparatus 100 further includes a graphical display module 60. The graphical display module 60 is configured to display parameters such as but not limited to time and temperature. It should be understood within the scope of the present invention that the shelf apparatus 100 includes the necessary electronics to capture, record and store informational parameters such as but not limited to time and temperature so as to be displayed on the graphical display module 60. Secured to the sidewall 3 is charging module 70. Charging module 70 is configured to charge personal electronic devices such as but not limited to cellular phones. It is contemplated within the scope of the present invention that the charging module 70 could be but is not limited to a USB port or a micro-USB port. Furthermore, it is contemplated within the scope of the present invention that the shelf apparatus 100 could include more than one charging module 70.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shelf apparatus configured to be mounted on a vertical surface or superposed a horizontal surface wherein the shelf apparatus comprises:

a central support member, said central support member having a plurality of walls contiguously formed to create an interior volume, said central support member having a first portion, a second portion and a third portion all being contiguously formed, said second portion being intermediate said first portion and said third portion, said second portion being angular with respect to said first portion, said central support member having a front wall, said front wall being manufactured from a translucent material, said central support member having a first side wall and a second side wall, said central support member having a rear wall;

a first shelf member, said first shelf member being planar in manner, said first shelf member being releasably secured to said second side wall, said first shelf member being oriented at a right angle with said second side wall;

a second shelf member, said second shelf member being operably coupled to said first sidewall of said first portion of said central support member, said second shelf member being oriented with said first portion such that an obtuse angle exists therebetween; and a graphical display module, said graphical display module configured to display informational parameters, said graphical display module mounted to the front wall of the central support member.

2. The shelf apparatus configured to be mounted on a vertical surface or superposed a horizontal surface as recited in claim 1, wherein said rear wall of said central support member includes a first aperture and a second aperture, said first aperture and said second aperture configured to facilitate receipt of a fastener extruding from a vertical wall.

3. The shelf apparatus configured to be mounted on a vertical surface or superposed a horizontal surface as recited in claim 2, wherein the first aperture is formed in the third portion of the central support member.

4. The shelf apparatus configured to be mounted on a vertical surface or superposed a horizontal surface as recited in claim 3, wherein the second aperture is formed in the first portion of the central support member.

5. The shelf apparatus configured to be mounted on a vertical surface or superposed a horizontal surface as recited in claim 4, and further including a mounting template, said mounting template having a first end and a second end, said mounting template having a first longitudinal member and a second longitudinal member, said second longitudinal member being oriented at an acute angle with said first longitudinal member between said first end and said second end of said mounting template.

6. The shelf apparatus configured to be mounted on a vertical surface or superposed a horizontal surface as recited in claim 5, and further including a third shelf member, said third shelf member being secured to said second sidewall and said second portion of the central support member, said third shelf member being oriented at an obtuse angle with the second sidewall of the second portion of said central support member.

7. The shelf apparatus configured to be mounted on a vertical surface or superposed a horizontal surface as recited in claim 6, and further including a fourth shelf member, said fourth shelf member being operably coupled to said first sidewall of said central support member on said third portion of said central support member, said fourth shelf member being oriented at an acute angle with said third portion of said central support member.

8. The shelf apparatus configured to be mounted on a vertical surface or superposed a horizontal surface as recited in claim 7, wherein said first shelf member includes a bottom edge, said bottom edge having a first section and a second section, said second section being inset with respect to said first section.

9. The shelf apparatus configured to be mounted on a vertical surface or superposed a horizontal surface as recited in claim 8, and further including a charging module, said charging module present on said central support member, said charging module operable to charge personal electronic devices.

10. The shelf apparatus configured to be mounted on a vertical surface or superposed a horizontal surface as recited in claim 9, and further including a light member, said light member being disposed within the interior volume of said central support member.

* * * * *